United States Patent [19]

Meyer

[11] 4,435,944

[45] Mar. 13, 1984

[54] APPARATUS FOR ORDERLY TRANSPORT AND STORAGE OF FLAT OBJECTS

[76] Inventor: Alfons Meyer, Donauschwabenstrasse 40, D-7050 Waiblingen, Fed. Rep. of Germany

[21] Appl. No.: 389,584

[22] Filed: Jun. 18, 1982

Related U.S. Application Data

[60] Division of Ser. No. 276,949, Jun. 24, 1981, Pat. No. 4,354,335, which is a continuation of Ser. No. 34,756, Apr. 30, 1979, abandoned.

[30] Foreign Application Priority Data

May 6, 1978 [DE] Fed. Rep. of Germany ..... 2819887

[51] Int. Cl.[3] ..... B65B 35/32

[52] U.S. Cl. ..... 53/531; 53/117; 53/244; 493/235; 493/335

[58] Field of Search ..... 53/429, 475, 117, 531, 53/244; 156/302, 303, 306, 265, 519, 552, 553, 156/559; 270/52, 58; 493/235, 335

[56] References Cited

U.S. PATENT DOCUMENTS

| | | | |
|---|---|---|---|
| 2,211,556 | 3/1939 | Brell et al. | 493/235 |
| 2,363,417 | 11/1944 | Heywood | 493/335 |
| 3,383,264 | 5/1968 | Welch | 493/335 |
| 3,506,525 | 4/1970 | Freemantle | 53/531 X |
| 3,815,318 | 6/1974 | Lerner | 53/570 X |
| 3,868,809 | 3/1975 | Bledsoe | 53/117 |
| 3,908,343 | 9/1975 | Farrelly | 53/570 X |
| 3,937,452 | 2/1976 | Gäth | 270/52 X |
| 3,980,006 | 9/1976 | Welch . | |

*Primary Examiner*—Horace M. Culver

*Attorney, Agent, or Firm*—Frishauf, Holtz, Goodman & Woodward

[57] ABSTRACT

In order to provide for the secure and orderly storage of flat objects on a carrier web, in particular unfilled plastic bags on a plastic carrier web, the invention provides a method and an apparatus for the sequential delivery of preformed plastic bags having a unilaterally extending attachment flap. The bags are delivered onto a moving carrier web also made of plastic film. Various alignment and positioning devices place the plastic bags seriatim on the carrier web while a heat-welding mechanism attaches the flap of each bag to the carrier web in a predetermined region. A tear line or perforation line permits subsequent removal of the bag from the web while the flap remains attached thereto. The apparatus includes power sources for the cyclic actuation of the alignment and welding mechanism in synchronism with the speed of delivery of the bags to and from the machine. The apparatus also includes a reciprocating storage container permitting the zig-zag layered stacking of the web with the attached bags.

8 Claims, 12 Drawing Figures

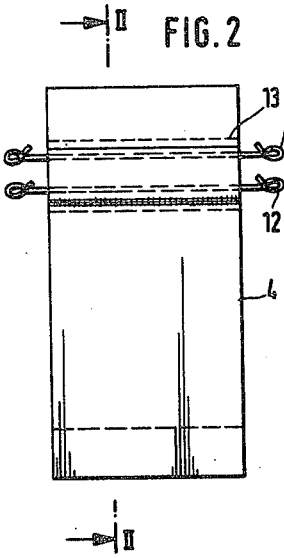
FIG. 2
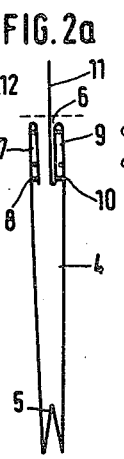
FIG. 2a
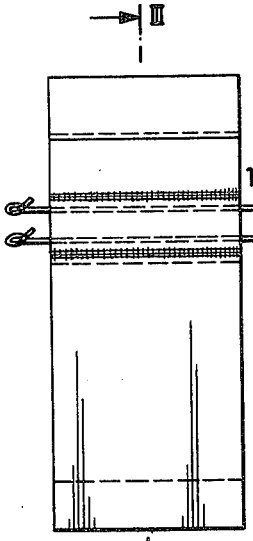
FIG. 3
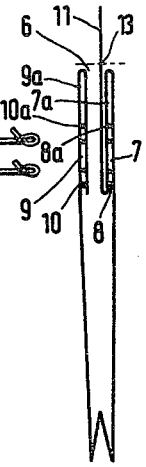
FIG. 3a
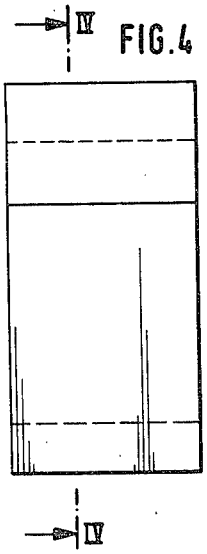
FIG. 4
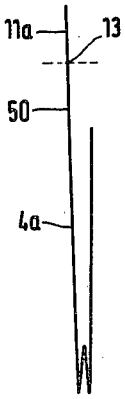
FIG. 4a
FIG. 5
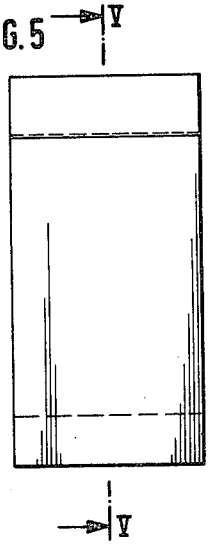
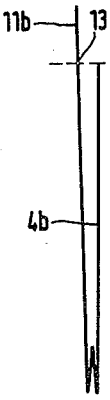
FIG. 5a

APPARATUS FOR ORDERLY TRANSPORT AND STORAGE OF FLAT OBJECTS

This is a division of application Ser. No. 276,949 filed June 24, 1981, and now U.S. Pat. No. 4,354,355, with is a continuation of Ser. No. 034,756, filed Apr. 30, 1979, now abandoned.

FIELD OF THE INVENTION

The invention relates to an apparatus for performing the orderly handling, transport and storing of flat objects, in particular of unfilled plastic container bags for the packaging industry. The invention relates particularly to a method and apparatus for handling unfilled plastic bags and arranging them in an orderly overlapping manner on a continuous plastic carrier web in such a way that their relative position is fixed and the carrier web may be stored, for example, in a zig-zag array within a box.

BACKGROUND OF THE INVENTION

In machinery which produces, for example, plastic containers or bags, these bags must be transported and stored in an orderly manner for subsequent delivery to a bag filling machine or the like. The supply of empty bags to the bag filling machine must take place in synchronism with the operating cycle of the filling machine which requires that the bags be delivered at uniform distances and in precisely aligned positions.

Known in the art are methods which require a relatively significant degree of manual labor for collecting bags in intermediate stations and the like. These methods suffer from the obvious disadvantages of such required manual intervention. Also known from the German Offenlegungsschrift No. 26 34 216 is a method for storing, transporting and distributing individual flat objects, in particular plastic bags. In this known method, the bags are correctly positioned and are laid in overlapping manner on a carrier web. A second covering web is applied continuously to the tops of the bags for the purpose of fixing their relative position. The two carrier webs including the bags held between them are then wound up on a storage roll.

The use of two separate carrier belts entails a relatively high expense. Furthermore, the position of the bags or the flat objects held between two carrier webs is not secure enough to prevent mutual displacement or rotation of the objects which can lead to great difficulties when these objects are delivered to a subsequent machine for further processing. Still another disadvantage of the known method is that it is not possible to store the belts and the objects or bags held therebetween in any manner except on a storage roll or spool. In particular it is not possible to store the belts in a flat folded (zig-zag) configuration within a box because the belts would then cease to hold the bags or objects in their correct position which would defeat their purpose.

OBJECTS AND SUMMARY OF THE INVENTION

It is a first principal object of the invention to provide a method for aligning flat objects in an orderly sequence and in a condition suitable for exactly positioned storage and delivery to a subsequent processing station.

This first principal object of the invention is attained by providing each of the objects with a protruding flap which can be separated from the object along a predetermined line. The method according to the invention further provides that the objects are positioned on a carrier web in overlapping configuration and that each of the protruding flaps is fastened permanently to the carrier web thereby fixing its relative position. During subsequent processing, the objects may be separated along the line of perforation while the protruding flap remains attached to the carrier web.

The attachment of the individual flaps to the carrier web in a permanent manner insures the exact and correctly positioned alignment of the objects with respect to the carrier web as well as with respect to the other objects on the web. For this reason the carrier web can be introduced into subsequent processing machines at relatively high speed because any relative displacement or rotation of the objects is positively prevented. A still further advantage of the method according to the invention is that the fixed position of the objects on the carrier belt due to their attachment by the protruding flap insures that they are delivered to any subsequent cyclically operating machine in the correct timing which can be synchronized with the operating speed of that machine by a relatively simple adjustment of the supply speed of the carrier web. The novel method according to the invention is capable of dealing with objects independently of their exact form and shape, for example it is possible to treat bags of different thickness, includding bags with a bottom pleat or with a string casing at the opening of the bag. The flap can be located at any suitable place on the object depending on its type. For example, it may suitably be disposed at the side of the object. If the objects are bags, it is advantageous if the flap is located in the vicinity of the bag opening. For example, the end of the bag may be folded over in zig-zag fashion and the end of the zig-zag fold may constitute part or all of the protruding attachment flap.

In order to insure a simplified detachment of the bags from its flap in a subsequent processing station, it is suitable to define a line of perforations between the flap and the associated bag. This line of perforations may be a continuous line or an intermittent weakening of the material so that a fracture line is defined which will guide the tearing and fracture of the material along that line if sufficient force is applied. In an advantageous embodiment of the invention, the carrier web is a heat-weldable plastic web on which the attachment flaps are welded. Due to the firm and secure attachment of the bags on the carrier web, the carrier web may be stacked in zig-zag fashion, for example in a box, and its beginning or end may be attached to that box so that the contents of a number of boxes may be attached to one another to insure a continuous feeding of the objects on the carrier web to the subsequent processing station.

It is an associated principal object of the invention to provide a plastic bag for use in the method according to the invention. The plastic bag according to the invention has a unilateral flap which may be detached from the bag along a predetermined line. The flap may be disposed at the bag opening and may be formed by a zig-zag fold of the bag wall in the vicinity of the bag opening.

The apparatus includes a transfer station with a cyclically operating mechanism which attaches the flaps of the objects on the carrier web in sequence, for example by heat-welding. The apparatus includes a mechanism for aligning and holding down the objects which can operate in the same rhythm as the overall delivery cycle of the machine. Furthermore, the alignment and hold-down mechanism can be adjusted to the format of the objects to be attached to the carrier web.

If the objects are heat-weldable and the carrier web is also heat weldable, then the fastening mechanism may advantageously be a heat-welding mechanism.

The apparatus according to the invention may include a bag constructing mechanism which operates automatically and which supplies the preformed bags to the alignment and attachment portion of the apparatus. If the objects are plastic bags, this bag making machine may be a folding machine which has elements that can impart one or more zig-zag folds to a partially prefolded plastic tube. The apparatus may further include displaceable storage mechanisms, for example a box carrier, which moves back and forth at the operating rhythm of the apparatus so as to cause the zig-zag layering of the finished carrier web.

One advantage of the invention is that the method and apparatus can include the use of a carrier web which is narrower than the objects to be fastened thereon. It is also advantageous if the region in which the fastening flap is attached to the carrier web is narrower than the object itself so that the edges of the objects are free. If the area of fastening is substantially in the center of the flap, it is especially practical to open the bag in a bag filling station while the flap remains attached to the carrier web. The attachement to the carrier web is preferably distributed over an area so as to insure the continued attachment of the flap to the web in subsequent processing steps.

Still further objects, advantages and features of the invention will become clear from a subsequent description of preferred exemplary embodiments of the invention.

DESCRIPTION OF THE DRAWING

FIG. 2 is a front elevational view of a bag according to the invention;

FIG. 2*a* is a view of the bag in FIG. 2 along the line II—II;

FIG. 3 is a front elevational view of a second embodiment of a bag according to the invention;

FIG. 3*a* is a section through FIG. 3 along the line III—III;

FIG. 4 is a front elevational view of a third embodiment of the invention;

FIG. 4*a* is a section of FIG. 4 along the line IV—IV;

FIG. 5 is a front elevational view of a fourth embodiment of the invention;

FIG. 5*a* is a section of FIG. 5 along the line V—V;

DESCRIPTION OF THE PREFERRED EMBODIMENTS

Figure 1:
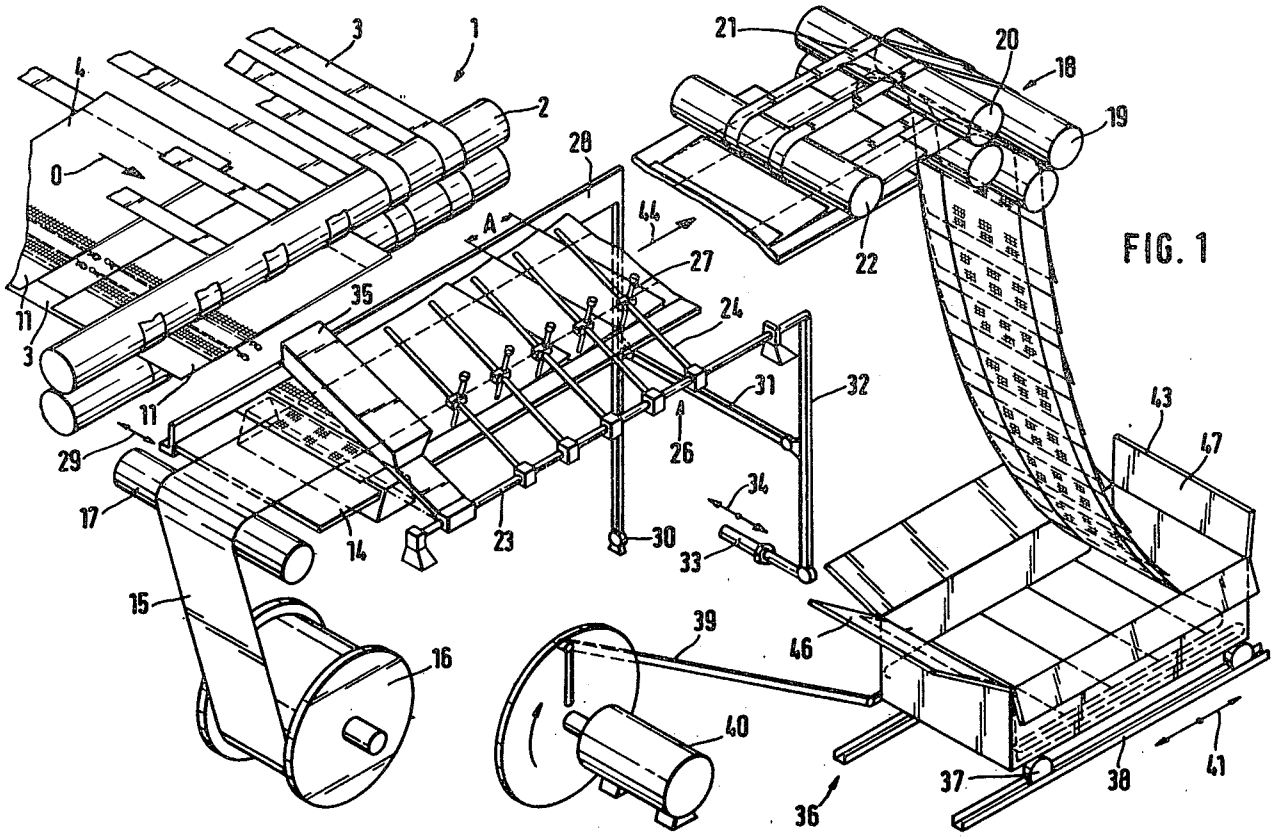
FIG. 1 is a perspective view of an apparatus according to the invention.

The apparatus illustrated in FIG. 1 includes a transport mechanism 1 in which a powered pair of rollers 2 transports endless conveyor belts 3 between which flat objects, for example plastic drawstring bags 4, are carried continuously in the direction indicated by the arrow 0. The drawstring bags 4 are seen to be carried side by side and are delivered by the rollers 2 in individual sequence.

Each of the drawstring bags 4 may be constructed as shown, for example, in FIGS. 2, 2*a* or 3, 3*a*. The bag 4 includes a bottom pleat 5 and is made from a folded plastic semi-tubular blank. The plastic blank is folded over once at the point 6 and forms a bottom seam 7, 7*a*. This seam is closed by welding at points 8, 8*a*. On the other side, the plastic foil is folded over twice to form a zig-zag pleat so as to define a top seam 9, 9*a* which is welded at points 10, 10*a*. The double pleat also defines a protruding flap 11 which extends beyond the opening 6 of the plastic bag (FIGS. 2, 3). The bottom seam 7 and the top seam 9 serve to receive a drawstring 12 in per se known manner.

A material weakening line 13 is located between the main extent of the bag 4 and the protruding flap 11.

As illustrated in FIG. 1, the bags 4 are delivered by the transport mechanism 1 in such a way that the long extent of the flaps 11 is perpendicular to the initial direction of transport 0.

A fixed table 14 is located in front of the rollers 2 and guides a continuous plastic carrier web 5 from a storage roll 16 after deviation of a roller 17. The carrier web 15 is transported by a web transport mechanism 18 which includes two pairs of powered rollers 19, 20, the top rollers of which guide endless conveyor belts 21 which are returned by a roller 22.

Disposed on the table 14 is an alignment mechanism including a shaft 23 disposed parallel to the table 14 and capable of rotation to which are attached the arms 24 of a positioning rake which carries downwardly extending pins 27 whose position on the arms 24 can be adjusted.

Located at the opposite side of the table 14 is an alignment rail 28 which can be moved back and forth in the directions indicated by the double arrow 29. The alignment rail 28 is pivoted at a joint 30 and is coupled by a linkage 31 and a secondary linkage 32 with the shaft 23. The linkage 32 may be moved back and forth in the sense of the double arrow 34 by per se known means, not shown.

Also disposed on the shaft 23 is a welding device 35 which shares the reciprocating motion of the positioning rake 26 induced by the pivoting of the shaft 23.

Following the web transport mechanism 18 is a storage mechanism 36 which includes a box carrier 37 that can move back and forth and guide rails 38 under the influence of a crank drive 39 powered by an electric motor 40. The motion takes places in the direction indicated by the double arrow 41. A storage container 43 can be mounted on the box carrier 37 as seen in FIG. 1.

Figure 6:
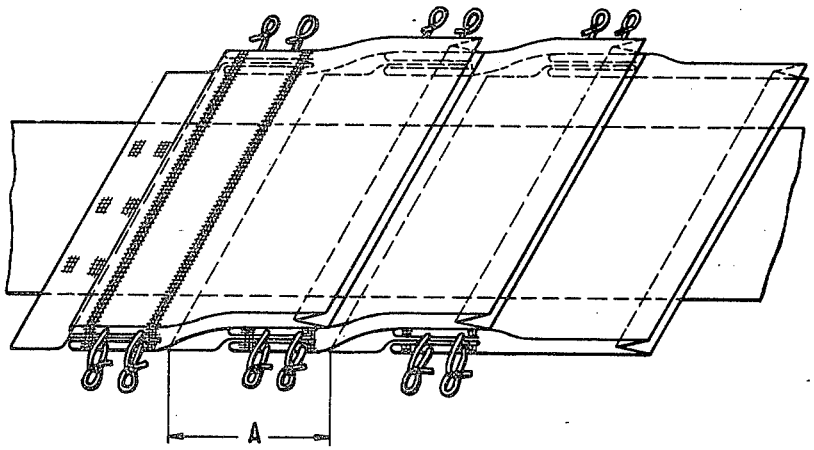
FIG. 6 is an illustration of the manner of placement of drawstring bags on a carrier web
Figure 7:
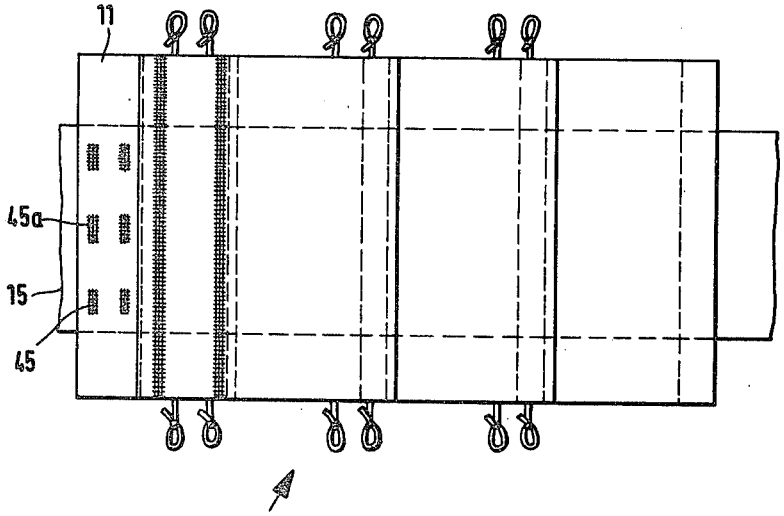
FIG. 7 is a top view of the illustration of FIG. 6.

The operation of the mechanism illustrated in FIG. 1 is as follows:

The pair of rollers 2 transports the bags 4 in the direction of the arrow 0 toward the table 14. When the bags fall free of the rollers 2, they made contact with the downwardly extending fingers 27 of the positioning rake 26. The bags 4 then drop downwardly onto the carrier web 15 which is moving in the direction of the arrow 44, i.e., perpendicular to the direction of the arrow 0. The speed of the carrier web 15 is adjusted to the transporting speed of the mechanism 1 so that the bags 4 will come to lie on the carrier web 15 in overlapping configuration in the manner of fish scales. This position is best seen in FIGS. 6 and 7. The protruding flaps 11 of the bags 4 make contact with the carrier web 15 and two adjacent flaps 11 may typically be separated from one another by a distance A (see FIG. 6). Due to the motions of the linkage 32 and the shaft 23, the positioning rake 26 moves up and down while the alignment rail 28 moves to and fro. The combined motion of these elements causes the bags 4 to be correctly positioned and oriented in sequence on the carrier web 15. During the synchronized downward motion of the positioning rake 26, the welding device 34 is also moved downwardly and permanently joins together the flap 11 of the last bag 4 and the adjacent part of the carrier web 15. The joint between the flap 11 and the carrier web 15 is made over an area 45 of finite extent, for example as seen in FIG. 7. The extended fastening prevents any separation of the flap 11 in subsequent processing and thus prevents any interference in the processing steps, for example during the filling of the plastic bags 4. However, depending on the circumstances, the heat welding of the flap may also be performed differently, for example only in the center of the flap as illustrated at 45*a* in FIG. 7. Such a manner of fastening permits the opening 6 of the bag to be particularly wide without being impeded by the attachment to the carrier web 15 at the sides of the flap.

After the attachment of the bags 4 to the carrier web 15 by means of their flaps 11, the carrier web 15 is transported by the web conveyor mechanism 18 and is guided into the storage box 23. The reciprocating motions of the box 43 are synchronized with the transport speed of the web 15 in such a way that the web 15 and the bags 4 attached thereto are placed in the box in a zig-zag layered stack.

It may be especially advantageous to attach the beginning of the carrier web 15 releasably to one flap 46 of the box 43, for example by an adhesive tape and to attach the end of the carrier web 15 on the other flap 47 in the same manner. In this way, two carrier webs from different boxes may be joined to one another so as to permit a continous feed of bags to the subsequent processing stations.

As seen in FIGS. 1 and 7, tthe width of the carrier web 15 is substantially less than that of the bags 4 which saves material and also facilitates the opening of the bag for the purpose of filling. However it is also possible to use carrier webs 15 which have the same width as the objects placed thereon. Although the illustrated embodiment includes a zig-zag layer storage of the bags 4 in the box 43, it is also possible within the scope of the invention to roll the web 15 and the bags 4 attached thereto on a storage spool.

The method and the apparatus of the invention also include the handling of other flat objects provided with an extending flap. An appropriate location of the flaps in drawstring bags has been explained above. If the objects are bags of the type illustrated in FIG. 4, the extending flap 11*a* may be merely a prolongation of one of the normal bag closing flaps 50 with a suitable line of perforations 13 provided as shown.

In another embodiment of a suitable bag for use in the method according to the invention, the flap 11*b* is an immediate continuation of one of the side walls of the bag separated therefrom by the line of perforations 13.

The embodiments described and illustrated have been of the type in which a flap 11, 11*a*, 11*b* is located in the general vicinity of the bag opening 6 because such a location of the flap 11 is especially advantageous for the subsequent filling of the bag. However it is also possible to consider embodiments in which the flap 11 is located at the side of the bag which may be more suitable for particular situations.

The bag transport mechanisms 1 may be stationed subsequent to a bag folding device which produces the bags 4 with the flaps 11. One embodiment of a bag folding device of this kind is illustrated schematically in FIG. 8. A plastic foil 51 provided with a bottom pleat 5 by apparatus not shown is transported into the folding device 53 in the direction of the arrow 52. The foil 51 travels across a first folding lever 54 which produces the top seam 9. During the subsequent motion a folding lever 55 produces the bottom seam 7 while a folding lever 56 forms extending flap 11. The formation of the top seam 9 and the bottom seam 7 is assisted by the passage of the drawstring 12 which enters the top and bottom seams via string guides 57, 58. The strings are received from storage spools, not shown, via eyelets 59 mounted on a rail 60.

Figure 8:
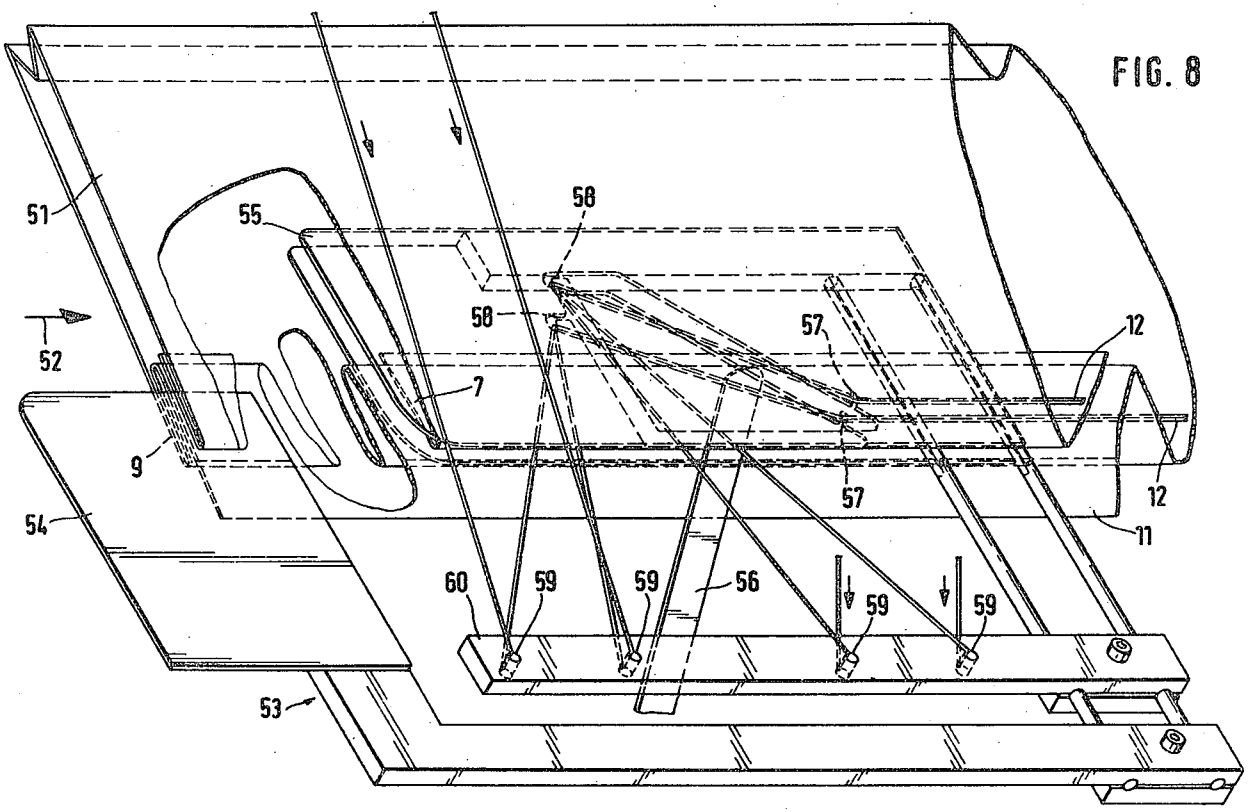
FIG. 8 is a perspective view of a folding mechanism for the production of bags according to the invention.

Following the bag folding station illustrated in FIG. 8 is a bag separating station, not shown in detail, in which the sides of the bag are welded and the line of perforations 13 is imparted to the bag 4 whereafter the finished bags are transported by the transporting mechanism 1 described above.

The motion of the carrier web 15 over the table 14 takes place in the embodiment described above in well-defined intermittent steps. The motion is imparted to the web 15 by rubber pressure rollers 19, 20 which are driven intermittently by an electric motor, not shown, acting via a clutch and a brake. However, the carrier web could also in principle be moved continuously at some appropriate speed in which case the welding device 35 would have to include a provision for accompanying the motion of the carrier web during the welding process for a period of time sufficent to produce the attachment of the flap 11 to the carrier web 15.

The forgoing description of preferred exemplary embodiments of the invention is considered to be non-limiting and is given only for the purpose of illustration. In particular, other embodiments and variants are possible and features of one embodiment may be used with features of any other embodiment without departing from the spirit and scope of the invention.

I claim:

1. An apparatus for ordering, transporting and storing flat empty bags (4) closed at three sides and having an opening (6) at the fourth side and an extending flap (11) located adjacent said bag opening and projecting therefrom, said bags being aligned seriatim and in overlapping position in shingled arrangement on a carrier web (15) in which the carrier web provides for storage and delivery of the bags to a subsequent processing station, comprising means for providing a tear or servering or fracture line (13) between the extending flap (11) and the remainder of the bag;

means for transporting the bags seriatim in a first direction (0) with their flaps extended at right angles to said first direction;

means for fixing the carrier web (15) in a direction (44) which is perpendicular to said first direction (0);

means for forwarding the bags, one after another, in predetermined time intervals in said first direction (0) at a level above said carrier web (15) from a first side of the carrier web and across the carrier web into an abutment or stop means (27) located at the second side of the carrier web;

means for dropping said bags over and on the carrier web in mutually overlapping position while guiding the drop of the then dropping bag on the web and forming a shingled arrangement of bags on the web;

means for aligning each side of the bag on the carrier web and exactly positioning the bags on the carrier web with their flaps at defined distances (A) from one another;

means for permanently and irremovably attaching said flaps of bags, as positioned and aligned onto said carrier web, seriatim at said defined distances (A) from one another to insure separation of the bag from the flap at said tear, severing or fracture line upon application of a severing force to the bag while leaving the flap attached to the web;

and means for storing said carrier web and said bags for subsequent separation of said bags from said flaps to permit subsequent filling, and separation and removal of said bags (4) from the web (15) while leaving the flaps (11) attached to the web (15).

2. An apparatus according to claim 1 wherein said attaching means includes cylically operating fastening means (35) for permanently attaching unilaterally extending flaps (11) of said objects to said carrier web, and wherein the cyclic operation of said fastening means is synchronized with the speed of delivery of said transport means.

3. An apparatus according to claim 2, wherein said fastening means (35) includes an alignment and hold-down device (26, 28) and wherein said fastening means (35) and said alignment and hold-down device (26, 28) are pivotable at a cyclic rate which is synchronized with the speed of delivery of said objects on said carrier web.

4. An apparatus according to claim 3, wherein said alignment and hold-down device (26, 28) includes adjustable stops (27) for adjustment to the format of said object (4), said stops (27) cooperating with a movable alignment rail (28).

5. An apparatus according to claim 2, wherein said fastening means (35) includes a folding mechanism (35).

6. An apparatus according to claim 1, wherein said transport means (1) includes an automatically operating mechanism for creating said flaps (11) on said objects (4).

7. An apparatus according to claim 6, wherein said mechanism for creating said flaps (11) on said objects (4) is a folding mechanism (53) including folding elements (56, 55) for imparting a zig-zag shaped pleat at the edge of a preformed plastic foil (51).

8. An apparatus according to claim 1, wherein said web storing means (36) includes a movable box carrier (37) which is capable of reciprocal motion in synchronism with the motion of said carrier web (15).

* * * * *